United States Patent [19]

Wang

[11] Patent Number: 4,724,882

[45] Date of Patent: Feb. 16, 1988

[54] ADJUSTABLE AWNING STRUCTURE

[76] Inventor: Jeng-Horng Wang, No. 14, Lane 158, Long En St., San Shya Jenn, Taipei Hsien, Taiwan

[21] Appl. No.: 923,634

[22] Filed: Oct. 27, 1986

[51] Int. Cl.[4] ..... E04F 10/06

[52] U.S. Cl. ..... 160/69; 160/46; 160/59; 135/89; 135/117; 211/195

[58] Field of Search ..... 160/64–66, 160/68–71, 46, 55, 56, 59; 135/89, 117, 112; 211/198, 195

[56] References Cited

U.S. PATENT DOCUMENTS

| | | | |
|---|---|---|---|
| 2,620,025 | 12/1952 | Powers | 160/64 |
| 3,789,903 | 2/1974 | Clark et al. | 135/89 X |
| 3,952,758 | 4/1976 | Addison et al. | 135/89 |
| 4,495,977 | 1/1985 | Delluc | 160/70 |

FOREIGN PATENT DOCUMENTS

| | | | |
|---|---|---|---|
| 764278 | 12/1956 | United Kingdom | 160/368 R |

*Primary Examiner*—Ramon S. Britts
*Assistant Examiner*—Blair M. Johnson
*Attorney, Agent, or Firm*—Wenderoth, Lind & Ponack

[57] ABSTRACT

An adjustable awning structure which can be assembled for use or disassembled for shipping and storage has two sides. The size of one or both sides of the canvas can be adjusted. The supporting angle of one or both sides of the canavas can also be adjusted. After being disassembled, the whole structure can be reduced to a small bundle for shipping and storage. The awning finds particular use for a user who travels quite often. Moreover, since the structure has a considerable supporting strength, the size of the canvas can be suitably varied, if necessary.

4 Claims, 6 Drawing Figures

ADJUSTABLE AWNING STRUCTURE

BACKGROUND OF THE INVENTION

Most of the conventional awnings are of the fixed type which may be classified into three categories, i.e. a one side type, a four-corner supporting type, and a two sloping side type. However, none of these types are adjustable. At most, the height of these may be adjusted. Since they are of the fixed structure, they are unable to meet the requirements of a travelling user, such as the ability to be set up, shipped and stored, etc. There is a sun umbrella recovered which can meet the aforesaid requirements, but its shading and covering area is limited as a result of its mechanical structure; in other words, it can not be used for covering a larger area because of its insufficient support structure.

SUMMARY OF THE INVENTION

This invention provides an adjustable awning structure, which comprises a main post assembly including main posts, supporting rods, and a fixing joint; a canvas setting-up structure including a canvas, a central shaft and canvas rods; a canvas driving mechanism including a housing, a worm, a crank, and a connecting pipe. The crank is used for driving the worm and the gear to rotate so as to cause the central shaft to roll up or unroll the canvas, and also to change the supporting angle of the supporting rod. Then, the slideable joint and extension rods are positioned. The aforesaid structure can also be used for adjusting the supporting angle of one side of the canvas awning, and for disassembling the whole structure for shipping and storing.

DETAILED DESCRIPTION OF THE PREFERRED EMBODIMENT

Figure 1:
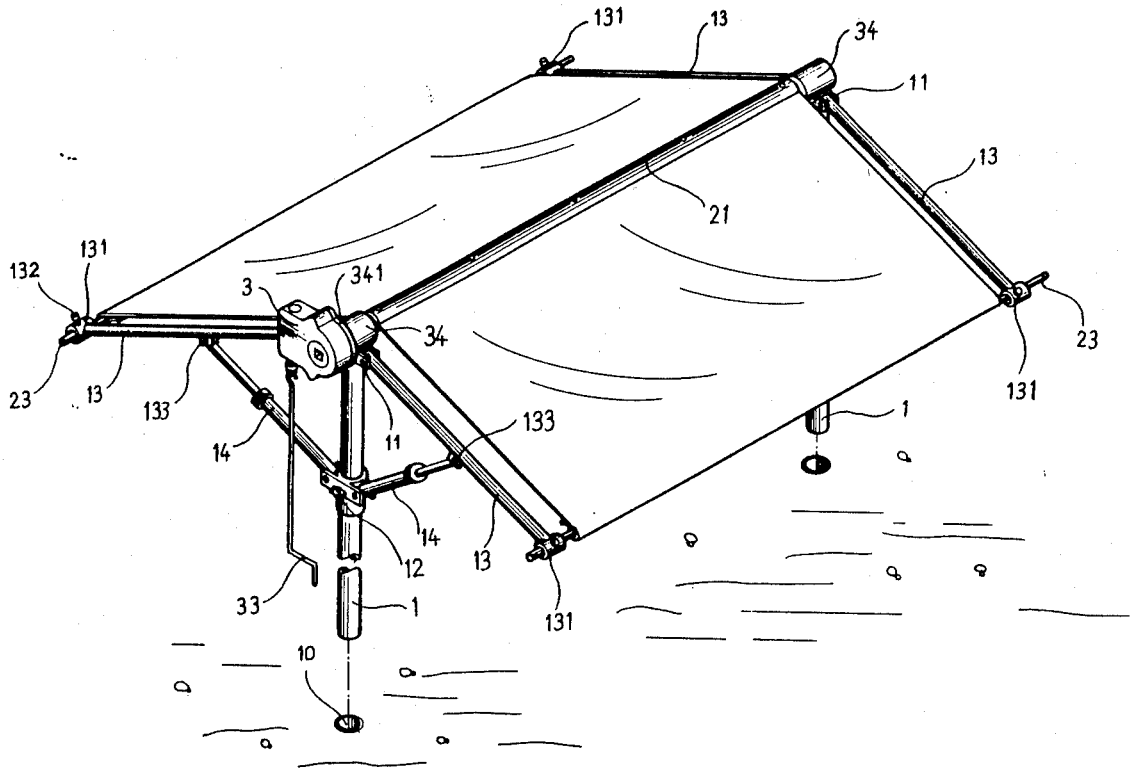
FIG. 1 is a perspective view of the awning structure according to the present invention.

FIG. 1 illustrates an adjustable awning structure of the present invention which comprises three major assemblies, i.e. the main post, the canvas setting-up structure, and the canvas-driving mechanism.

Figure 2:
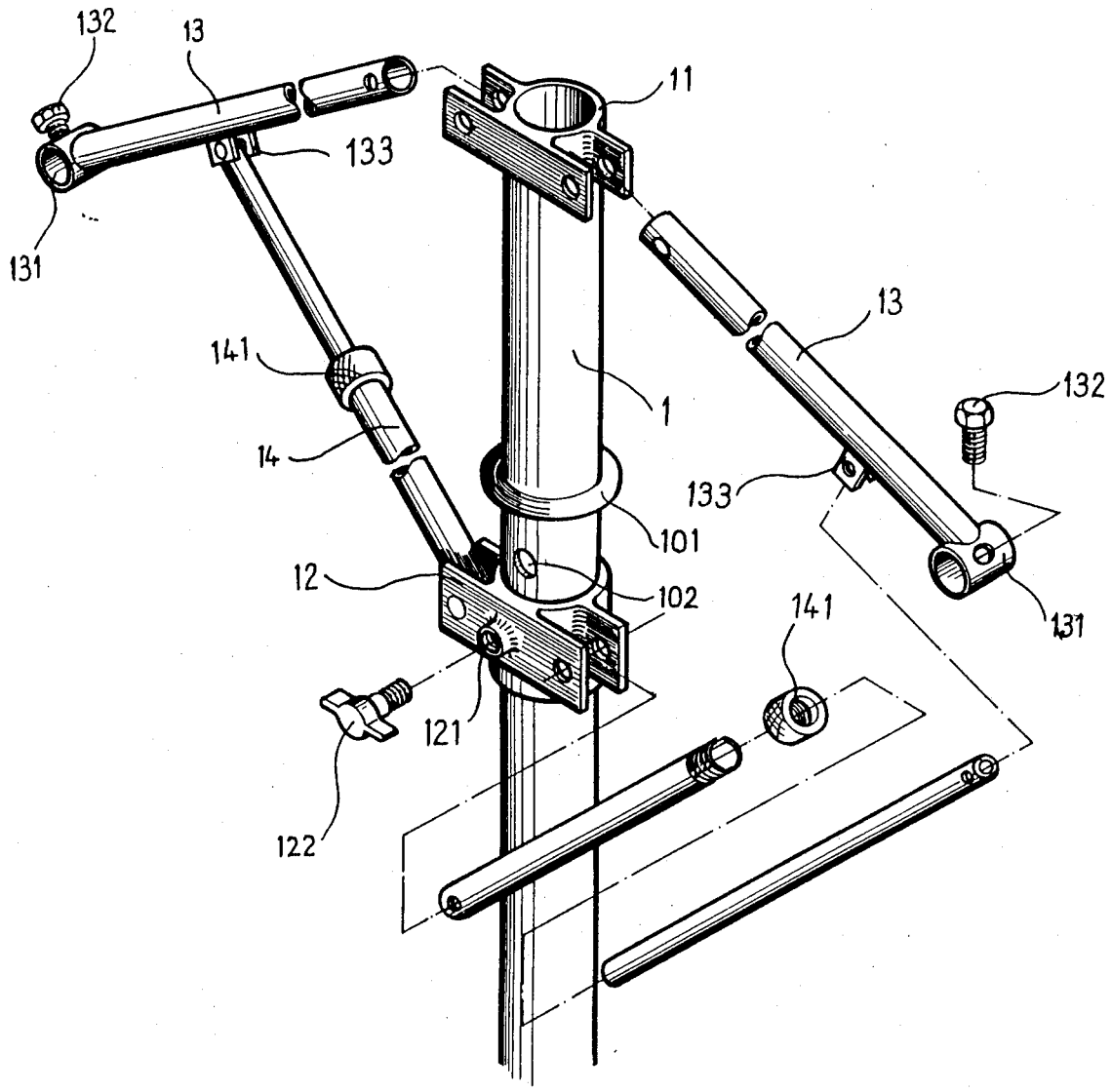
FIG. 2 is a disassembled view of the main post of the awning structure of the present invention.

The main post as shown in FIG. 2 includes:

two main posts 1, of which the lower ends are to be inserted into a hollow cylinder being either driven into the ground or mounted on a fixture, while the tops therof are each furnished with a fixing joint 11, and on the upper portion of the main posts 1, slideable joints 12 are mounted. Within the upper and lower sliding limits of the slideable joints, there are two stop rings 101 and one or several screw holes 102 spaced at regular intervals between the two stop rings. The screw hole may be a simple through hole or a groove extending around the main post.

The fixing joint 11 is directly fixed on the top end of each main post 1. The joint 11 may be replaced with a plate having two extended lugs with holes being welded on the top of the main post 1 so as to pivotally connect the supporting rods 13.

The slideable joint 12 with lugs is mounted between the upper and lower stop rings 101 and is to pivotally connected to the extension rods 14. The slideable joint 12 is also furnished with a screw hole 121 that is mated with a lock screw 122, which is to be screwed into the screw hole 102 or screwed against the main post 1 so as to fix the slideable joint 12 in position.

One end of the supporting rod 13 is pivotally connected to the fixing joint 11, while the other end thereof is furnished with a horizontal hollow cylinder 131 having a lock screw 132 for locking the canvas rod 23 in position. Under the middle portion of the supporting rod 13, there is a pair of joint lugs 133 for providing a pivotal connection for one end of the extension rod 14. The extension rod 14 includes outer and inner extension tubes, of which one end of the outer tube is furnished with an opened slot, some external threads and a coupling sheeve 141 so as to enable the outer and inner tubes connected together to adjust to a suitable length. The front end of the outer tube of the extension rod 14 is pivotally mounted to the lugs of the slideable joint 12. The upper end of the inner tube is pivotally mounted to the joint lugs 133 under the supporting rod 13.

After each main post 1, supporting rod 13 and the extension rod 14 are assembled together, the angle of between each supporting rod 13 and main post 1 can be determined by fixing the position of the slideable joint 12 and adjusting the length of the extension rod 14. The length of the two extension rods 14 may or may not be the same.

Figure 3:
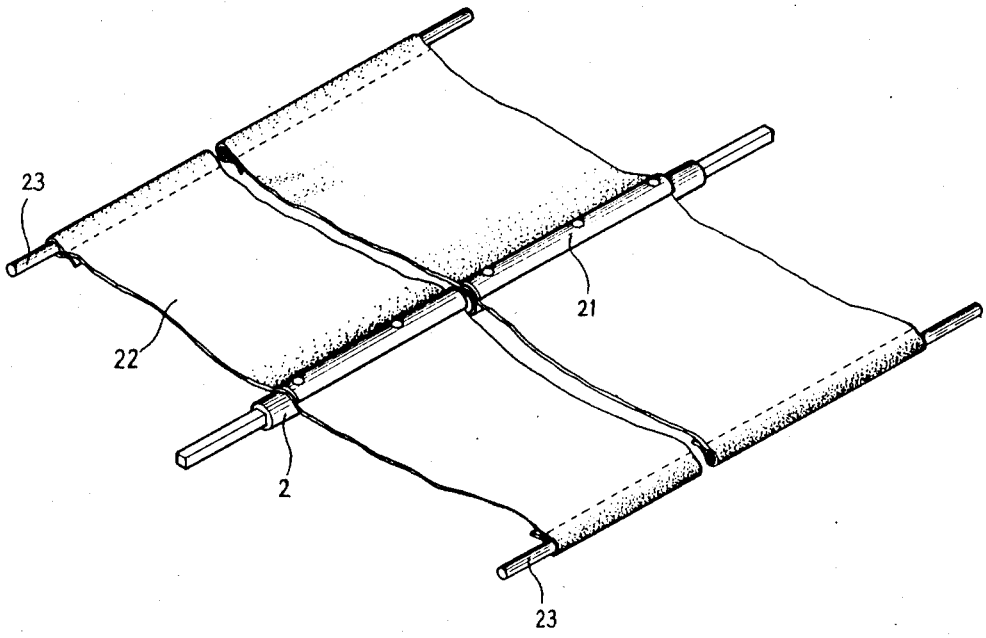
FIG. 3 is a perspective view of the canvas set up on the awning structure according to the present invention.

FIGS. 1 and 3 illustrate the canvas setting-up structure of the present invention, which includes a central shaft 2 having a round body portion and two ends shaped as square portions, an arc-shaped fastening strip 21 to be mounted with nails on the central shaft after the canvas 22 is mounted along the central shaft 2, and two canvas rods 23 being sleeved in the two canvas edges sewed into two sleeves respectively. Both ends of the two canvas rods 23 extend out of the canvas sleeves respectively so as to be inserted into the horizontal hollow cylinders 131 of the supporting rods 13 respectively.

Figure 4:
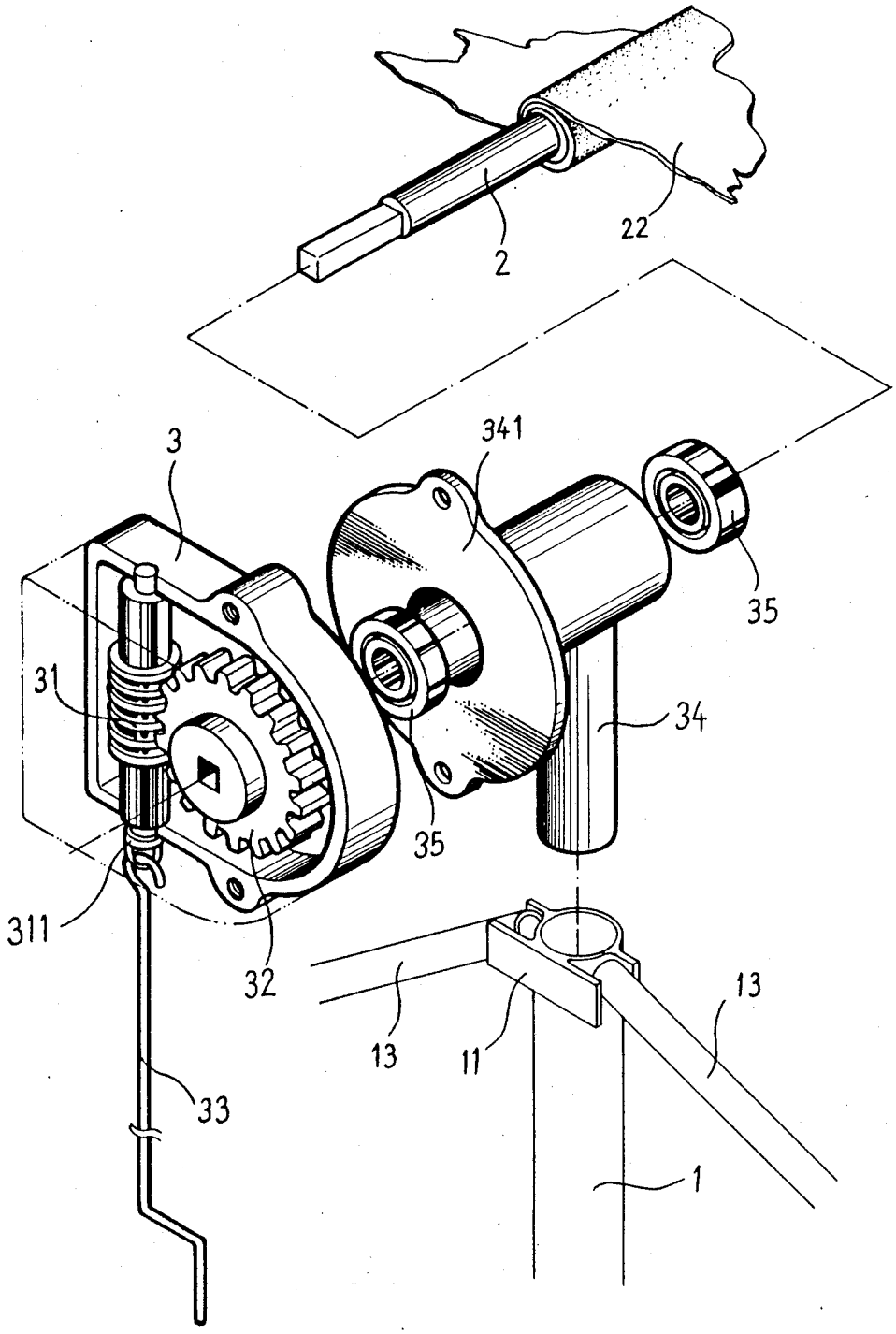
FIG. 4 is a disassembled view of a driving mechanism to roll up the canvas of a recovered awning according to the present invention.
Figure 5:
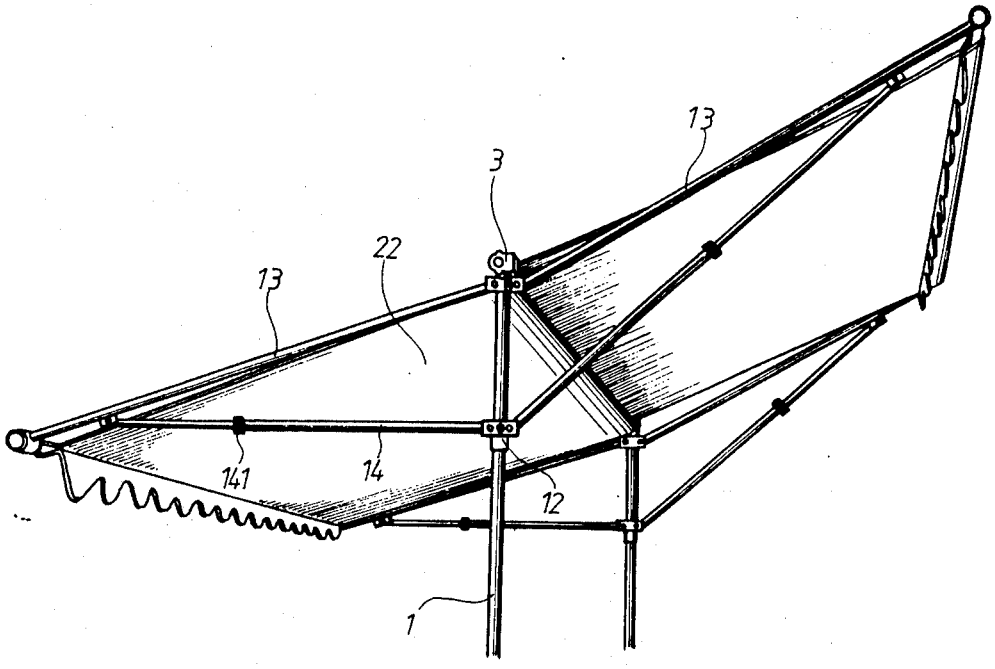
FIG. 5 is a perspective view of the awning of the present invention, being set up.

FIG. 4 illustrates the canvas driving mechanism, which comprises a housing 3 made of two pieces in which the worm 31 and the gear 32 are mounted. The worm 31 engages with the gear 32 and has both ends thereof pivotally and fixedly monuted on the housing 3; the lower end thereof extends out of the housing 3 and comprises a hook ring 311 for engaging with a crank 33. The S-shaped crank 33 is used for driving the worm 31 to cause the gear 32 to rotate.

The connecting pipe 34 is substantially a T-shaped pipe of which the vertical portion is insertable into the fixing joint 11 on the top of the main post 1, while the horizontal portion thereof is optionally furnished with a fixing plate 341. As shown in FIG. 4, the horizontal portion is furnished with a fixing plate 341 so as to mount the housing 3 on the outer side thereof with the gear 32 and the horizontal portion of the connecting pipe 34 aligned coaxially. After the bearings 35 are mounted to the horizontal portion of the connecting pipe 34, the square end portion of the central shaft 2 can be mounted in the square hole of the gear 32 to complete a driving mechanism. Since the other end of the central shaft 2 has no driving mechanism, the other connecting pipe 34 is not mounted to a fixing plate 341 and a housing 3 but merely has a bearing 35 mounted to the horizontal portion of the connecting pipe 34 so as to accommodate the other end of the central shaft 2 therein. The connecting pipe offsets the central longitudinal axis of the shaft 2 from the pivotal connection between each supporting rod 13 and fixing joint 11.

Both of the ends of the central shaft 2 are mounted inside the horizontal portions of the two connecting pipes 34 on the top of the two main posts 1 respectively; one end of the central shaft 2 is further fitted into the gear 32 hole in the housing 3. Upon rotation of the crank 33, the worm 31 will drive the gear 32 to cause the central shaft 2 to rotate synchronously therewith. Since the canvas 22 is fixed on the central shaft 2, and the central longitudinal axis of the shaft 2 is offset from the pivotal connection between each supporting rod 13 and fixing joint 11 the rotation of the shaft 2 causes the canvas to roll up on or to unroll from the shaft so as to change the distance between the central shaft 2 and the two canvas rods 23 and to adjust the length of the extension rods 14.

FIG. 1 illustrates the awning structure being spread. The adjusting steps are that the coupling sleeves 141 of the extension rods 14 are first loosended, and the crank 33 is then rotated to adjust the spreading length of the canvas 22 so as to set the position of the supporting rod 13 (being pulled by the canvas), and then the position of the slideable joint 12 is fixed so as to fix the length of the extension rods 14 before they are locked in position. The length of the extension rods 14 may be adjusted so as to be different from each other if necessary. The supporting rod 13 may be comprised at one or more rods so as to allow the two canvas rods 23 to be set at different heights; in other words, the canvas 22 on either side of the central shaft 2 may be oriented at a different angle than that at the other side by merely adjusting the canvas rod 23 and the extension rod 14 without effecting the other canvas side.

Figure 6:
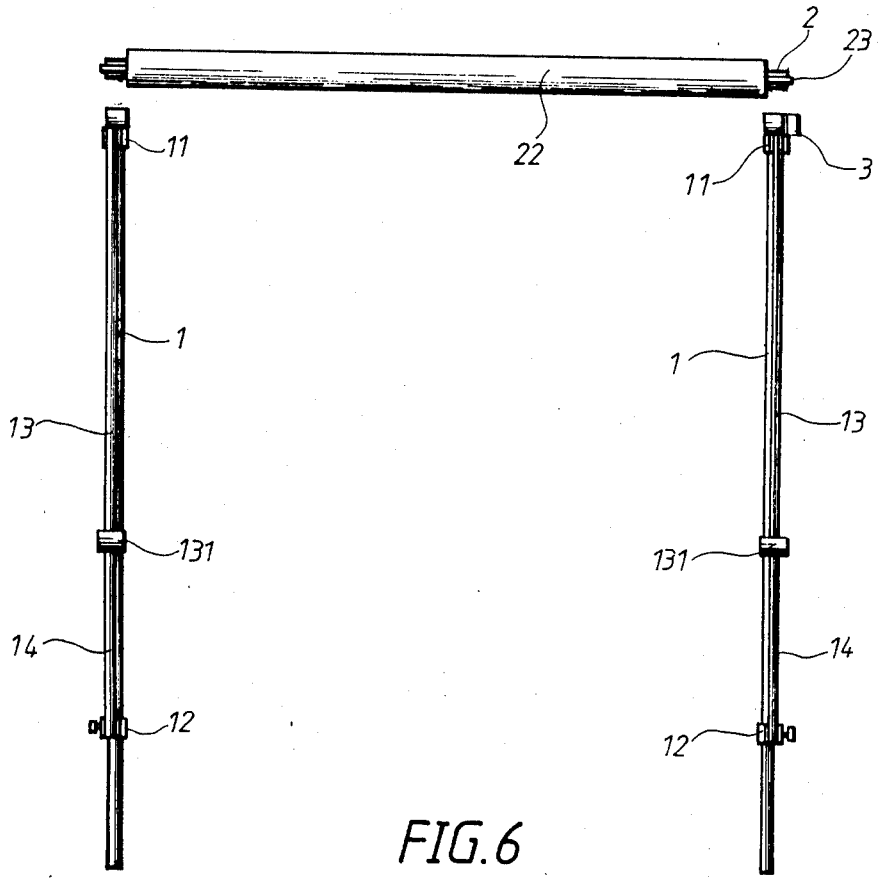
FIG. 6 illustrates the awning being recovered.

FIG. 6 shows the awning structure of the present invention being recovered for storage. The canvas setting-up mechanism may be disassembled and rolled up and the canvas driving mechanism may also be removed from the main post 1. The slideable joint 12 may be slid down the lowest portion of the main post 1 so as to allow the extension rods 14 to become almost parallel with the main post 1 before pulling the main post out of the hollow cylinder 10. It is deemed that the present invention is an awning structure that is convenient and practical. Other modifications of the present invention will be apparent to those of ordinary skill in the art and are intended to be embraced by the true spirit and scope of the present invention as set forth in the appended claims.

What is claimed is:

1. An adjustable awning comprising:

at least one main post;

a respective slidable joint slidably mounted to each said at least one main post, and respective locking means for releasably fixing the slidable joint at a position on each said at least one main post;

a respective fixing joint fixed at an end of each said at least one main post, said fixing joint having a lug means;

at least one supporting rod pivotally mounted to said fixing joint at the lug means and extending therefrom to a respective end thereof;

at least one extendable and retractable extension rod means extending between said respective slidable joint and said at least one supporting rod, each said at least one extension rod means pivotally mounted at one end thereof to said respective slidable joint and at the other end thereof to a respective said at least one supporting rod at a location thereon that is spaced from the lug means at which said at least one supporting rod is pivotally mounted to said fixing joint;

a rotatable shaft mounted to and extending from the end of said at least one main post, and means for rotatably mounting said shaft to the end of said at least one main post at a location that is offset from said lug means at which said at least one supporting rod is pivotally mounted to said fixing joint;

a respective canvas rod mounted to and extending from the end of each said at least one supporting rod;

a sheet of canvas extending between and secured to said rotatable shaft and each said respective canvas rod; and a canvas driving mechanism operatively connected to said rotatable shaft for rotating said rotatable shaft secured to said sheet of canvas to roll said sheet of canvas around said shaft when the shaft is rotated in one rotational direction and to unroll said sheet of canvas from around said shaft when the shaft is rotated in a rotational direction opposite to said one rotational direction.

2. An adjustable awning as claimed in claim 1, wherein said at least one main post comprises two main posts, said rotatable shaft mounted to and extending between the ends of said two main posts, said at least one supporting rod comprises two supporting rods pivotally mounted to each of the fixing joints each fixed to a respective one of the ends of the two main posts, and said at least one extension rod means comprises two extension rods pivotally mounted to the slidable joints each of which is slidably mounted to a respective one of the two main posts.

3. An adjustable awning as claimed in claim 2, wherein said means for rotatably mounting said shaft comprises two T-shaped connecting pipes each of which is secured to a respective said end of the main posts, and further comprising a fixing plate connected to one of said connecting pipes, said canvas driving mechanism being mounted to said fixing plate.

4. An adjustable awning as claimed in claim 1, wherein said canvas driving mechanism comprises a two piece housing, a worm and worm gear meshing with said worm within the housing, the worm having an end thereof extending from the housing and shaped as a hooked ring, the gear having a square-shaped hole extending therethrough, said means for rotatably mounting comprises a T-shaped connecting pipe fixed at the end of said at least one main post, said pipe having a vertical portion extending within said fixing joint and a horizontal portion, a fixing plate connected to the horizontal portion and to which said housing is mounted, at least one bearing within the horizontal portion for rotatably supporting said rotatable shaft, and a crank having a hook engaging the hooked ring of said worm and a bent portion by which the crank is rotatable so as to rotate the worm and worm gear meshing therewith, and said rotatable shaft has a square-shaped end complimentary to and extending in said square-shaped recess.

* * * * *